United States Patent [19]

Young

[11] 4,226,039

[45] Oct. 7, 1980

[54] MULTI-POCKETED HOLDER FOR FILM AND CARD STORAGE

[75] Inventor: Raymond R. Young, Glenview, Ill.

[73] Assignee: Wilson Jones Company, Chicago, Ill.

[21] Appl. No.: 930,367

[22] Filed: Aug. 2, 1978

[51] Int. Cl.[3] ..... G09F 1/10

[52] U.S. Cl. ..... 40/373; 40/124.2; 40/405

[58] Field of Search ..... 40/124.2, 124.4, 404, 40/405, 373, 374, 382, 388, 391, 156, 152.1, 158 R, 159 R, 606, 610; 248/441 D, 460, 463, 464; 229/69, 72

[56] References Cited

U.S. PATENT DOCUMENTS

| | | | |
|---|---|---|---|
| 1,358,463 | 11/1920 | Rand, Jr. | 40/373 |
| 3,339,874 | 9/1967 | Kerstens | 248/463 |
| 4,085,534 | 4/1978 | Eckstein et al. | 40/124.2 |
| 4,085,535 | 4/1978 | Schweinberg | 40/124.2 |

FOREIGN PATENT DOCUMENTS

| | | | |
|---|---|---|---|
| 977504 | 4/1951 | France | 40/391 |
| 1444249 | 5/1966 | France | 40/124.2 |

*Primary Examiner*—John F. Pitrelli
*Assistant Examiner*—G. Lee Skillington
*Attorney, Agent, or Firm*—Pennie & Edmonds

[57] ABSTRACT

A film and card holder constructed of a plurality of terraced V-shaped pocket panels held in a semi-rigid frame, the pocket panels being spaced selected distances from one another by spacing tabs integrally formed in and extending from the bottoms of adjacent panels. The frame includes apertures for receiving a foldable stand for positioning the holder in an upstanding position for use.

6 Claims, 7 Drawing Figures

MULTI-POCKETED HOLDER FOR FILM AND CARD STORAGE

BACKGROUND OF THE INVENTION

Prior microfiche holders have employed foldable double pockets permanently mounted in frame arrangements. U.S. Pat. No. 2,005,453 to Chadwick discloses V-shaped pockets for holding cards. Chadwick's device provides spaced pocket panel on both sides and includes a frame suitable for storage in a loose leaf binder. Holders have also been adapted to be placed in upstanding positions. For example, U.S. Pat. No. 3,959,904 to Holiday shows a microfiche storage unit including a pair of hinged covers to permit the device to be positioned in a standing position.

It is also recognized in the art that microfiche panels may include V-shaped pockets adapted to be held in vertically positioned stands.

These prior holders have not included solutions to the pocket spacing problem or to providing a foldable stand arrangement that the present invention provides.

SUMMARY OF THE INVENTION

Broadly, the present invention is a film and card holder having two spaced apart frame pieces for holding, in compressed engagement, a plurality of terraced V-shaped pocket panels. Panels are spaced apart using spacer tabs which project below the base line of one panel and abut the base line of the panel immediately below.

It is a feature of the holder that an easel stand is readily attachable and detachable from the frame pieces and further that the holder is easy to assemble and versatile to use since pockets are presented on both sides of the holder.

It is also a feature of the present invention that the V-shaped pockets are self-spacing during assembly and further that the self-spacing elements serve as dividers preventing engagement of objects stored in one portion of the V-shaped pocket from touching objects stored in the opposite portion of the V-shaped pocket.

DESCRIPTION OF THE EMBODIMENT OF THE INVENTION

Figure 1:
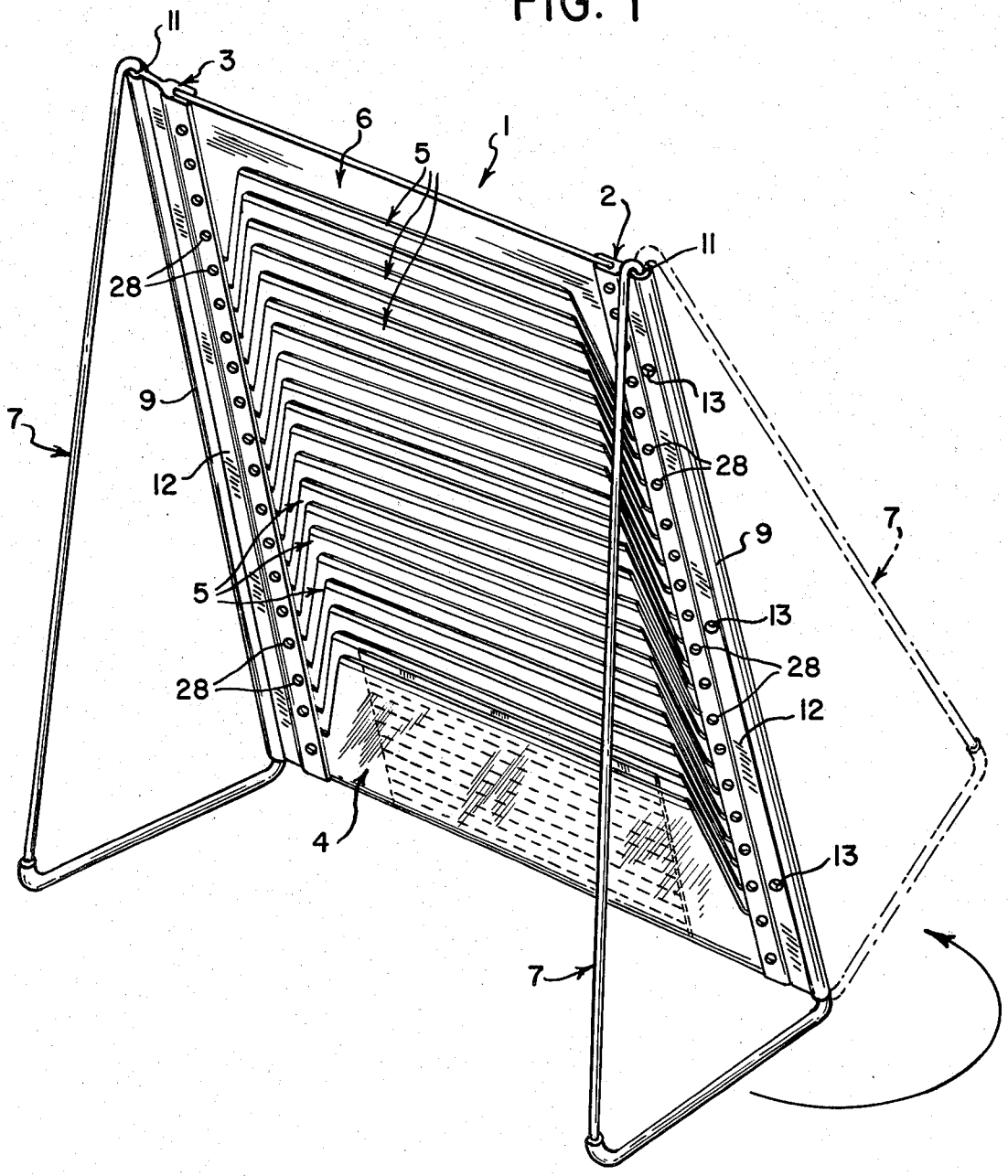
FIG. 1 is a perspective view of the holder including assembled panel and attachable foldable easel stand.

Referring to FIG. 1, holder 1 comprises two side frames pieces 2 and 3 positioned generally parallel to one another and a bottom panel 4, a plurality of V-shaped pocket panels 5 and top panel 6. Frame pieces 2 and 3 are preferably made of plastic or other similarly deformable material. Holder 1 is supported by two easel stands 7, one inserted into the ends of frame piece 2 and the other engaged in frame piece 3. The easel stands 7 can be folded against either the front or back of panel 1 when the holder is being stored.

Figure 3:
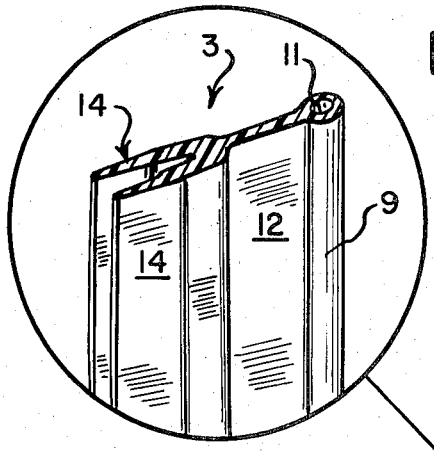
FIG. 3 is an expanded view of a circled area of FIG. 2.
Figure 2:
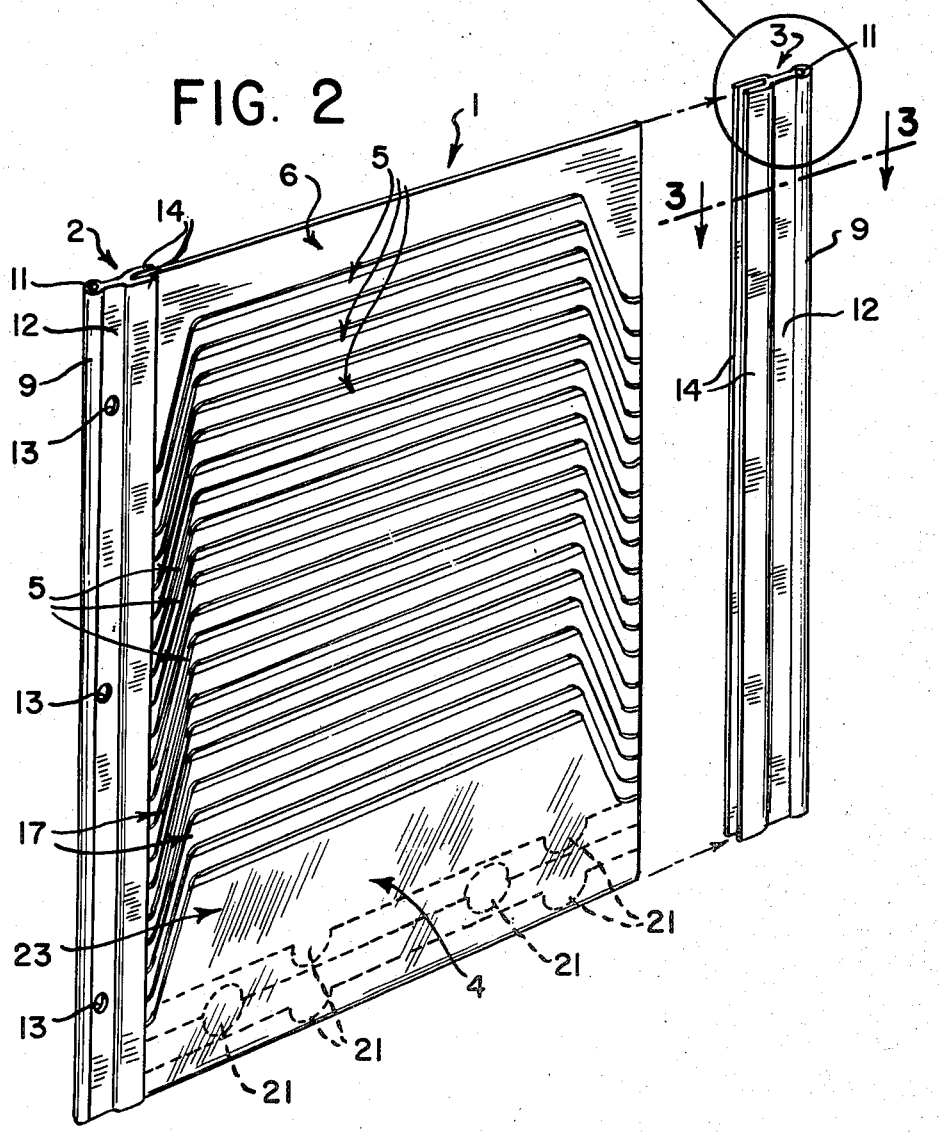
FIG. 2 is a side elevational view of the holder with stand removed.

Turning to FIGS. 2 and 3, it is seen that frame pieces 2 and 3 are each integrally formed to include an elongated tubular-shaped end portion 9 with a rod-receiving aperture 11 at each end. Alternatively, end portion 9 may have one aperture extending throughout its length so that it can receive a rod throughout its length, if desired, for positioning holder 1 in a suitable binder, stand or other mount.

Adjacent to and integrally-formed with outside portion 9 is spacer portion 12 which may have holes 13 in it positioned so that the panel can be placed in a ring binder. Connected to spacer portions 12 are bifurcated pocket panel-receiving portions 14.

Figure 4A:
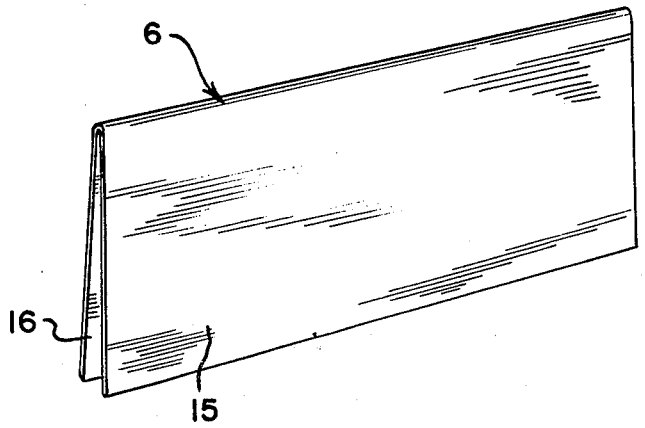
FIG. 4(a–c) is a perspective view of the bottom panel, a V-shaped pocket panel and a top panel.
Figure 4B:
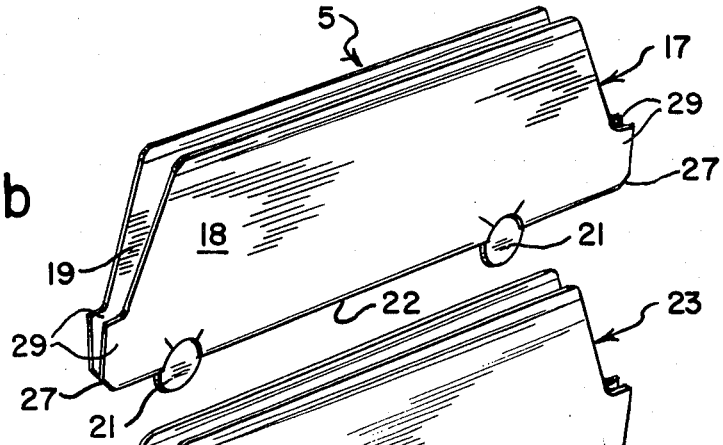
Figure 4C:
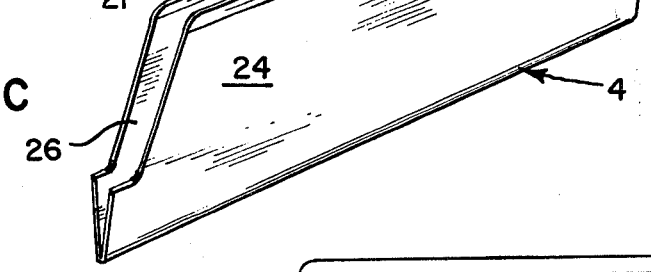

Turning to FIGS. 4(a–c) and 5, and particularly FIG. 4(a), top panel 6 includes a front side 15 and back side 16. With reference to FIG. 4(b), pocket 17 of V-shaped pocket panel 5 is formed by front wall 18 and back wall 19 and base crease 22 formed by folding to create such walls. Pocket panels 5 are made of plastic or other similarly deformable material. Back wall 19 carries spacer-tabs 21 which are formed from the cutting-semicircular portions from front wall 18 (see FIG. 5). Such semicircular cutting leaves openings 20 in the bottom area of the panel. Walls 18 and 19 are generally tapered from a point spaced from crease 22 so that the upper portion of the walls are, after folding, progressively narrower as the distance from the crease 22 increases. In FIG. 4(c), bottom panel 4 is seen with front and back walls 24 and 26, respectively, which form a pocket 23.

Figure 5:
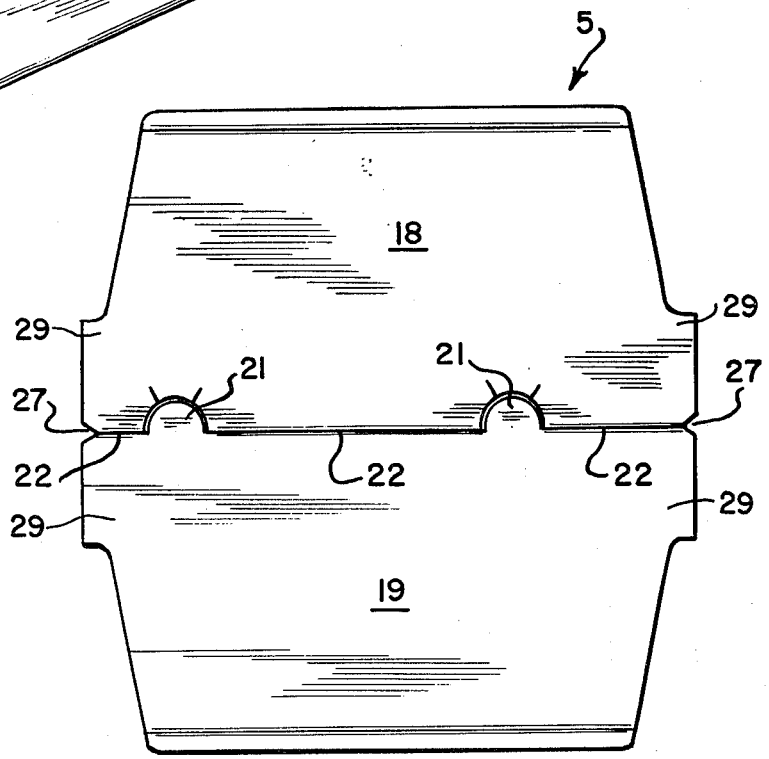
FIG. 5 is a plan view of a V-shaped pocket prior to folding and assembly.

In FIG. 5, corners 27 of walls 18 and 19 at the ends of crease 22 are removed to reduce the thickness in these areas after folding and assembly of panel 5. Walls 18 and 19 have panel end portions 29 for insertion into panel-receiving portion 14 of frame piece end portions 9. The positions of the spacer tabs 21 along base crease 22 are varied so that a tab 21 of one panel does not enter an opening 20 of the panel immediately below causing misalignment or misterracing of the panels. Two sets of pocket panels 5 may be used, one set with tabs closer to one frame piece and the other set with tabs closer to the other frame. In assembly, preferrably a panel from every other set is inserted in and moved down portions 14 of the frame piece (see FIG. 2).

Assembly of holder 1 is accomplished by first holding frame pieces 2 and 3 in spaced apart relation, then inserting bottom panel 4 until it is positioned with its lower most edge at the lower most edges of pieces 2 and 3. Next pocket panels 5 are inserted seriatim with the first panel being moved down until the spacer tabs engage the fold line or base crease of bottom panel 4. Thereafter, each pocket panel 5 is moved down until the spacer tabs 21 engage the base crease 22 of the pocket panel preceding it. Finally, top panel 6 is added and positioned with its lower most edges at, or close to, the fold line of the top most pocket.

After positioning of the panels has been completed, a plurality of deformations or indentations 28 are formed, by application of compressive forces against the surfaces of frame pieces 2 and 3 to form indentations 28 in both the pieces and the underlying panels. The frame pieces and panels may be heated to form, after cooling, a permanent bond between such pieces and the panels 4, 5 and 6. Finally, wire stands may be inserted in the completed holder to provide stands.

Spacer tabs 21 function not only to space the pocket panels but also separate a card, microfiche or other object introduced in the pocket from one side of the holder from an object introduced in the pocket panel from the other side of the holder.

I claim:

1. A film and card holder comprising (a) two spaced-apart frame pieces which include panel receiving portions;

(b) a first and a second pocket panel each of which in turn comprises (i) two opposing walls attached along a base crease;

(ii) at least one spacer tab unitary with the panel and depending below the base crease; and (iii) end portions positioned in said panel receiving portions; and (c) the first pocket panel being nested in the second pocket panel with the spacer tab of the first panel abutting the base crease of the second panel.

2. The holder of claim 1 further including (a) a top panel positioned and secured between the spaced-apart frame pieces above the upper most pocket panel; and (b) a bottom panel also positioned between and secured to the frame pieces below the lower most pocket panel.

3. The holder of claim 1 in which a frame piece has rod-receiving apertures at each end and having an easel stand positioned in such apertures.

4. A film holder comprising (a) two spaced-apart deformable frame pieces having panel receiving portions;

(b) deformable pocket panels inserted between said frame pieces with panel end portions positioned in the panel receiving portions;

(c) one such pocket panel having a unitary and depending spacer tab, another such pocket panel having a crease therein, and said one panel being nested in said other panel with said spacer tab bearing against said crease to space said panels with respect to each other; and (d) said frame pieces and panels being attached to one another by forces sufficient to create deformation of such pieces and panels such that the panels are not movable in the frame pieces during use of the holder.

5. The holder of claim 1, or 2, or 3, or 4, in which said spacer tab is located at other than the midpoint of its associated pocket panel as measured between the end portions thereof.

6. The holder of claim 5, in which said spacer tab is integral with and cut out from the material of its pocket panel.

* * * * *